United States Patent [19]

Mathur

[11] Patent Number: 5,070,939

[45] Date of Patent: Dec. 10, 1991

[54] PLATE HEAT EXCHANGER

[75] Inventor: Achint P. Mathur, Wichita Falls, Tex.

[73] Assignee: Tranter, Inc., Augusta, Ga.

[21] Appl. No.: 702,249

[22] Filed: May 17, 1991

[51] Int. Cl.[5] ..... F28F 3/10

[52] U.S. Cl. ..... 165/166; 165/167

[58] Field of Search ..... 165/166, 167

[56] References Cited

U.S. PATENT DOCUMENTS 4,995,455 2/1991 Mathus ..... 165/166

FOREIGN PATENT DOCUMENTS 2618889 2/1989 France ..... 165/166
WO850052 1/1985 PCT Int'l Appl. ..... 165/166
416550 9/1981 U.S.S.R. ..... 165/166
2071303A 9/1981 United Kingdom ..... 165/166
2078926A 1/1982 United Kingdom ..... 165/166
2080930A 2/1982 United Kingdom ..... 165/166

*Primary Examiner*—Allen J. Flanigan
*Attorney, Agent, or Firm*—Barnes, Kisselle, Raisch, Choate, Whittemore & Hulbert

[57] ABSTRACT

Each plate of the heat exchanger has the usual groove for receiving a gasket. The gasket has a main body portion secured to the bottom of the groove by spots of glue at spaced points along the length of the groove. The gasket is free of attachment to the groove between the spaced points. Nubs may be molded on the outer or inner edge of the gasket at spaced points to indicate where the glue is applied. The nubs lie in lateral extensions of the groove. The spots of glue, instead of being located in the groove proper to adhere the main body portion of the gasket, may be located in the groove extensions to adhere the nubs.

14 Claims, 1 Drawing Sheet

PLATE HEAT EXCHANGER

This application is a substitute of my application Ser. No. 07/139,304 filed Dec. 29, 1987, now abandoned, and contains new matter.

This invention relates generally to plate heat exchangers and refers more particularly to a plate heat exchanger having heat exchanger plates provided with one or more grooves in which gaskets are secured.

BACKGROUND AND SUMMARY OF THE INVENTION

A plate and frame heat exchanger consists of several corrugated heat transfer plates which are clamped together between a stationary frame and a movable frame. The plates with their gaskets hang vertically from a horizontal carrying bar. To insure that the gaskets on the plate will not fall off the vertical plates, the gaskets are glued in the gasket grooves of the plates prior to hanging of the plates on the carrying bar. According to present practice, the gaskets are glued by means of a continuous line of glue in the gasket groove of the plate.

In accordance with this invention, the glue is applied at spaced points in the gasket groove instead of in a continuous glue line. It has been discovered that by spot gluing at spaced points instead of gluing in a continuous line, the time required to secure a gasket in the groove is substantially reduced, and also the task of gasket and glue removal, as when it becomes necessary to replace a gasket, is made easier and faster. In addition, nubs may be molded on the inner or outer edge of the gasket at spaced points to indicate where the glue is to be applied.

It is a primary object of this invention to provide a gasket and heat exchanger plate having some or all of the above features.

Other objects, features and advantages of the invention will become more apparent as the following description proceeds, especially when considered with the accompanying drawings.

DETAILED DESCRIPTION

Figure 1:
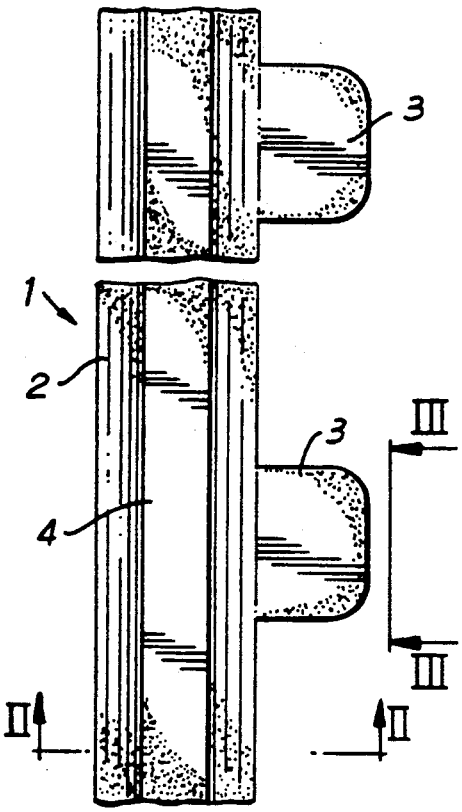
FIG. 1 is a top plan view, with parts broken away, of a typical gasket with projecting nubs.
Figure 2:
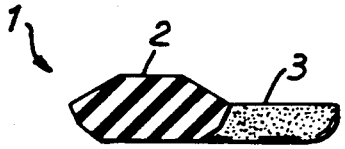
FIG. 2 is a sectional view taken along the line II—II in FIG. 1.
Figure 5:
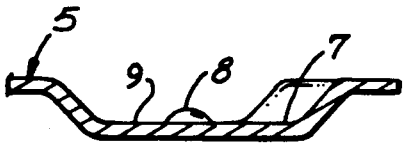
FIG. 5 is a sectional view taken on the line V—V in FIG. 4.

Referring now more particularly to the drawings and especially FIG. 1 - 5, there is shown a gasket 1 having an elongated main body portion 2 provided with integral nubs 3. The nubs 3 are spaced apart, preferably equal distances, and project laterally from the main body portion 2 of the gasket on one side or the other of the main body portion, but as shown, preferably on the side of the main body portion remote from the heat exchange area of the plate to be sealed. The main body portion 2 of the gasket has a raised ridge 4 along its length which abuts and seals against the heat exchanger plate in front of it to define a sealed heat exchange area of each plate.

A heat exchanger plate 5 is shown as having an elongated groove 6 which extends around the perimeter of the plate. The main body portion 2 of the gasket is adapted to lie and seal in the groove 6 around the perimeter of the plate to provide a sealed heat exchange area inside the gasket.

The plate is shaped to provide lateral extensions 7 of the gasket groove, which are spaced apart the same distances as the nubs of the gasket in order to receive the nubs when the gasket is placed in the groove.

Before laying the gasket in the groove, a spot of adhesive or glue 8 is placed in the bottom 9 of the groove 6 at spaced points along the length thereof. These spots of glue preferably are located at points corresponding to the groove extensions, as shown.

When the gasket is laid in the groove, it is positioned such that the nubs 3 extend into the extensions 7. The main body portion 2 of the gasket becomes secured to the bottom of the groove at spaced points by the glue. The gasket need not be secured to the plate at any other point.

Spot gluing of the gasket to the bottom of the gasket groove is thus carried out at spaced points only, along the length of the peripheral gasket groove of the heat exchanger plate. The projecting nubs 3 are provided only at those locations where the spot gluing is to be performed. The nubs are not glued to the plate and do not serve as an attaching means, but merely serve to indicate where the glue is applied underneath the main body portion of the gasket. When it is desired to remove a gasket, the nubs indicate immediately where the glued points of attachment are located.

Figure 6:
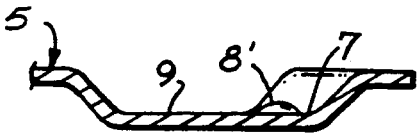
FIG. 6 is a sectional view similar to FIG. 5 but showing a modification.
Figure 3:
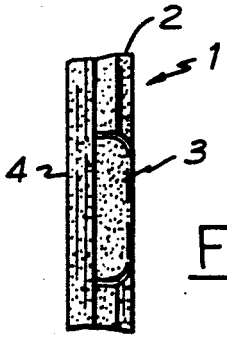
FIG. 3 is a side elevational view of the gasket and a nub, taken along line III—III of FIG. 1.
Figure 4:
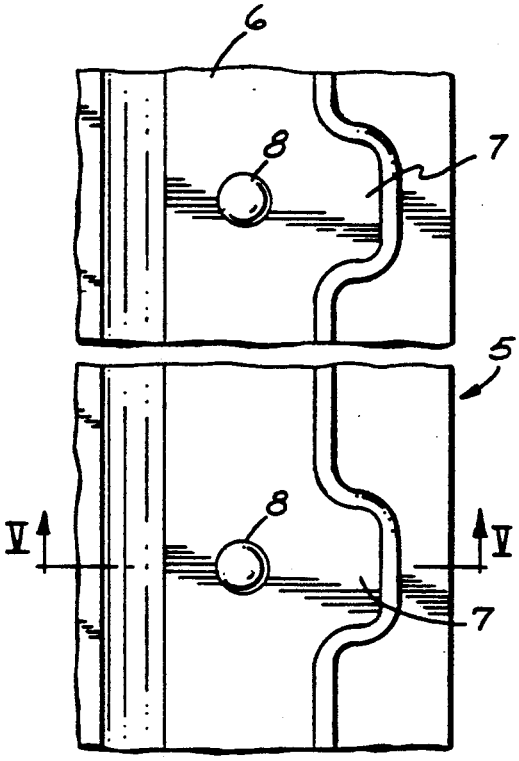
FIG. 4 is a plan view, with parts broken away, of portions of a gasket groove in a heat exchanger plate.

FIG. 6 illustrates a modification in which the spots of glue 8' are placed not in the bottom of the groove proper, but instead in the bottoms of the groove extensions 7. When the gasket is laid in the groove 6 with the nubs disposed in the groove extensions 7, the nubs 3 become secured by the spots glue 8' in the groove extensions, thus retaining the main body portion 2 of the gasket in the groove 6. The gasket is secured by the glue contacting the nubs and is otherwise free of attachment to the plate.

This invention is a test proven method. The sealability and integrity of the plate heat exchanger unit is not compromised by the spot gluing technique. Much time is saved by spot gluing rather than gluing along a continuous line. Also, much less time is required to remove a spot-glued gasket.

Specific examples of a heat exchanger plate and gasket made according to this invention have been described and illustrated. Other modes of applying the principals of the invention may be used, provided that the features stated in any of the following claims or the equivalents thereof are employed.

I claim:

1. In combination, a heat exchanger plate having an elongated groove defining a sealing area, a gasket having an elongated main body portion seated in and adapted to seal in said groove, said main body portion of said gasket being adapted to seal against an adjacent heat exchanger plate to define a heat exchange area of each plate, and means for adhering said main body portion of said gasket in said groove, at spaced points along the length thereof, said means for adhering comprising an adhesive material.

2. The combination defined in claim 1, wherein said main body portion of said gasket is free of attachment to said groove between said spaced points.

3. The combination defined in claim 1, wherein said main body portion of said gasket is adhered to the bottom of said groove by said adhering means.

4. The combination defined in claim 1, wherein said adhesive material comprises spots of glue at said spaced points.

5. The combination defined in claim 1 including means for indicating the location of said spaced points.

6. The combination defined in claim 5, wherein the means for indicating the location of said spaced points comprises nubs projecting from the side of said main body portion of said gasket at points corresponding to said spaced points.

7. The combination defined in claim 6, wherein said groove has groove extensions in which said nubs are disposed.

8. The combination defined in claim 1, wherein said adhesive material comprises spots of glue adhering the main body portion of said gasket to the bottom of said groove at said spaced points, said main body portion being free of attachment between said spaced points.

9. The combination defined in claim 8, including means for indicating the location of said spaced points.

10. The combination defined in claim 9, wherein said means for indicating the location of said spaced points comprises nubs projecting from the side of said main body portion of said gasket at points corresponding to said spaced points.

11. The combination defined in claim 10, wherein said groove has groove extensions in which said nubs are disposed.

12. In combination, a heat exchanger plate having an elongated groove defining a sealing area, a gasket having an elongated main body portion seated in and adapted to seal in said groove, said main body portion of said gasket being adapted to seal against an adjacent heat exchanger plate to define a heat exchange area of each plate, said gasket having nubs projecting from the side of said main body portion of said gasket at spaced points along the length thereof, and means for adhering said nubs to said plate, said means for adhering comprising an adhesive material .

13. The combination defined in claim 12, wherein said groove has groove extensions receiving said nubs, and said adhesive material comprises spots of glue in the bottoms of said groove extensions.

14. The combination defined in claim 13, wherein said main body portion of said gasket is free of attachment to said groove.

* * * * *